United States Patent [19]

Usami

[11] Patent Number: 4,630,518

[45] Date of Patent: Dec. 23, 1986

[54] ELECTRONIC MUSICAL INSTRUMENT

[75] Inventor: Ryuuzi Usami, Tokyo, Japan

[73] Assignee: Casio Computer Co., Ltd., Tokyo, Japan

[21] Appl. No.: 656,691

[22] Filed: Oct. 1, 1984

[30] Foreign Application Priority Data

Oct. 6, 1983 [JP] Japan ..... 58-185846

[51] Int. Cl.[4] ..... G10F 1/00

[52] U.S. Cl. ..... 84/1.03; 84/DIG. 12

[58] Field of Search ..... 84/1.03, DIG. 12, 478

[56] References Cited

U.S. PATENT DOCUMENTS 4,402,244 9/1983 Nakada et al. ..... 84/1.03

*Primary Examiner*—Arthur T. Grimley

*Assistant Examiner*—David Warren

*Attorney, Agent, or Firm*—Frishauf, Holtz, Goodman & Woodward

[57] ABSTRACT

Melody data stored in a memory is sequentially read out and sounded with the operation of a one-key switch. In the memory is also stored accompaniment data, which is automatically played under the control of a microprocessor. The timing of the operation of the switch for the melody is compared to the normal timing of the piece. If the difference between the two compared timings is less than Δt, the accompaniment is automatically played at a normal timing. If it is greater than Δt, the tempo of the accompaniment is corrected.

5 Claims, 12 Drawing Figures

FIG. 8

| F | E | A | C | B | A | 9 | 8 | 7 | 6 | 5 | 4 | 3 | 2 | 1 | 0 | $A_0$ / $A_1A_2$ | |
|---|---|---|---|---|---|---|---|---|---|---|---|---|---|---|---|---|---|
| OBLIGATO START ADDRESS | | | | | | | | MELODY LINE START ADDRESS | | | | | | | | 0 | 0 |
| 0 | 0 | OFF $B_4^b$ | | ♩ | | ON $B_4^b$ | | CHORD LINE START ADDRESS | | | | | | | | 1 | 0 |
| 0 | 0 | OFF $A_4$ | | ♪ | | ON $A_4$ | | 0 | 0 | OFF $B_4^b$ | | ♩ | | ON $B_4^b$ | | 2 | 0 |
| 0 | 0 | OFF $F_4$ | | ♪ | | ON $F_4$ | | 0 | 0 | OFF $G_4$ | | ♪ | | ON $G_4$ | | 3 | 0 |
| 0 | 0 | 0 | 0 | 0 | 0 | END | | 0 | 0 | OFF $C_4$ | | ♪ | | ON $C_4$ | | 4 | 0 |
| 0 | 0 | OFF $G_2$ | | ♪ | | ON $G_2$ | | 0 | 0 | OFF $E_2^b$ | | ♪ | | ON $E_2^b$ | | 5 | 0 |
| 0 | 0 | OFF $E_3^b$ | | ♪ | | ON $E_3^b$ | | 0 | 0 | OFF $B_2^b$ | | ♪ | | ON $B_2^b$ | | 6 | 0 |
| 0 | 0 | OFF $A_2$ | | ♪ | | ON $A_2$ | | 0 | 0 | OFF $F_2$ | | ♪ | | ON $F_2$ | | 7 | 0 |
| 0 | 0 | OFF $E_3^b$ | | ♪ | | ON $E_3^b$ | | 0 | 0 | OFF $C_3$ | | ♪ | | ON $C_3$ | | 8 | 0 |
| 0 | 0 | D. D. C. | | ♩ | | $E^b$ | | 0 | 0 | 0 | 0 | 0 | 0 | END | | 9 | 0 |
| 0 | 0 | 0 | 0 | 0 | 0 | END | | 0 | 0 | D. D. C. | | 𝅗𝅥 | | $F_7$ | | A | 0 |

ELECTRONIC MUSICAL INSTRUMENT

BACKGROUND OF THE INVENTION

This invention relates to an electronic musical instrument for automatically playing music by sequentially reading out a plurality of autoplay data at a predetermined timing.

There have hitherto been electronic musical instruments in which autoplay music data is stored in a memory, and which at the time of automatically playing is sequentially read out and automatically played. Particularly, in order to facilitate the manual practice of beginners, it has been contemplated to construct an electronic musical instrument so that the read timing of data from the memory and key operation timing are compared when the keyboard is operated to play music automatically. When key depression timing for the melody part is behind the normal timing, the other part such as an accompaniment are temporarily suspended. As soon as the next key depression for the melody is done, the automatic play of the other part is restored with the preset tempo. If the key depression timing is advanced to normal timing of the autoplay, the other part is fast fed too.

Further, there has been used an electronic musical instrument which has a melody guide function which facilitates practice by displaying at least the note of the tone to be sounded next on a display means consisting of light-emitting diodes or the like arranged in correspondence to the individual keys on the keyboard. Further, there has also been used an electronic musical instrument which has a one-key play function so that melody data can be read out for one tone after another and played when a predetermined key is switched on and off.

Further, there has also been an electronic musical instrument in which not a single automatically played musical piece, but a plurality of automatically played musical pieces, e.g., the first melody, second melody, chord, etc., is stored in a memory and this data is simultaneously reproduced for the autoplay function.

With an electronic musical instrument in which the reading of data from the memory is timed with the key depression, the keyboard is operated for the melody part of music and the other parts of the piece, such as the chords, are produced following the key operation of the melody part. In this case, when the timing of the depressed key for the melody part is delayed, the autoplay of the other parts is suspended from the normal timing and is only resumed at the initial tempo when another melody key is depressed. Therefore, even if the key depression is delayed very slightly, the autoplay of the other parts of music is interrupted. Every time the autoplay is interrupted, the piece itself is marred, deteriorating the interest of the performer, particularly the beginner who has difficulty in operating keys properly.

SUMMARY OF THE INVENTION

An object of the invention is to provide an electronic musical instrument, which permits even a beginner, who has difficulty in operating keys normally, to continue automatic playing with a degree of contentment to maintain the player's interest.

According to one aspect of this invention, there is provided an electronic musical instrument having a memory, in which a plurality of autoplay data to be played simultaneously is stored, the data being sequentially read out at a predetermined timing for automatic playing. The electronic musical instrument comprises a means for reading out at a predetermined rate at least one item of secondary autoplay data among a plurality of autoplay data except for the main autoplay data read out and played by the performer's operation of the main playing means; and a correcting means for comparing the timing of the playing operation with respect to the main autoplay data to the normal timing of the piece. The flow of the secondary autoplay data is corrected when the result of comparison is beyond a predetermined range, and the flow of the secondary autoplay data is read out at the normal timing when the result of comparison is within the predetermined range.

According to another aspect of the invention, there is provided an electronic musical instrument having a memory in which a plurality of autoplay data to be played simultaneously is stored, the data being sequentially read out at a predetermined timing for the autoplay function. This electronic musical instrument comprises a guide means for indicating at least the next tone in main autoplay data to be read out and played by the performer's operation of the main playing means among the plurality of autoplay data; a keyboard operated in accordance with the guide means; a reading means for reading at a predetermined rate at least one item of secondary autoplay data except for the main autoplay data; and a correcting means for comparing the timing of the performance with respect to the main autoplay data to a normal timing of playing and correcting the reading rate of the secondary autoplay data when the result of comparison is beyond a predetermined range while reading out the secondary autoplay data at a normal timing when the result of comparison is within the predetermined range.

BRIEF DESCRIPTION OF THE DRAWINGS

FIG. 8 shows an example of autoplay music data stored in the memory shown in FIG. 7.

DETAILED DESCRIPTION OF THE PREFERRED EMBODIMENT

An embodiment of the invention will now be described in detail with reference to the drawings. In the following embodiment of the electronic musical instrument, the autoplay data for the melody, obligato, chord and rhythm are stored in a memory. The electronic musical instrument has a one-key play function and a melody guide function, as will be described later. In the one-key play function or melody guide function, the autoplay data for the melody is read out according to the operation of a one-key switch or keyboard keys. Also, the automatic playing of obligato, chord and rhythm are executed following the playing of the melody.

Figure 1:
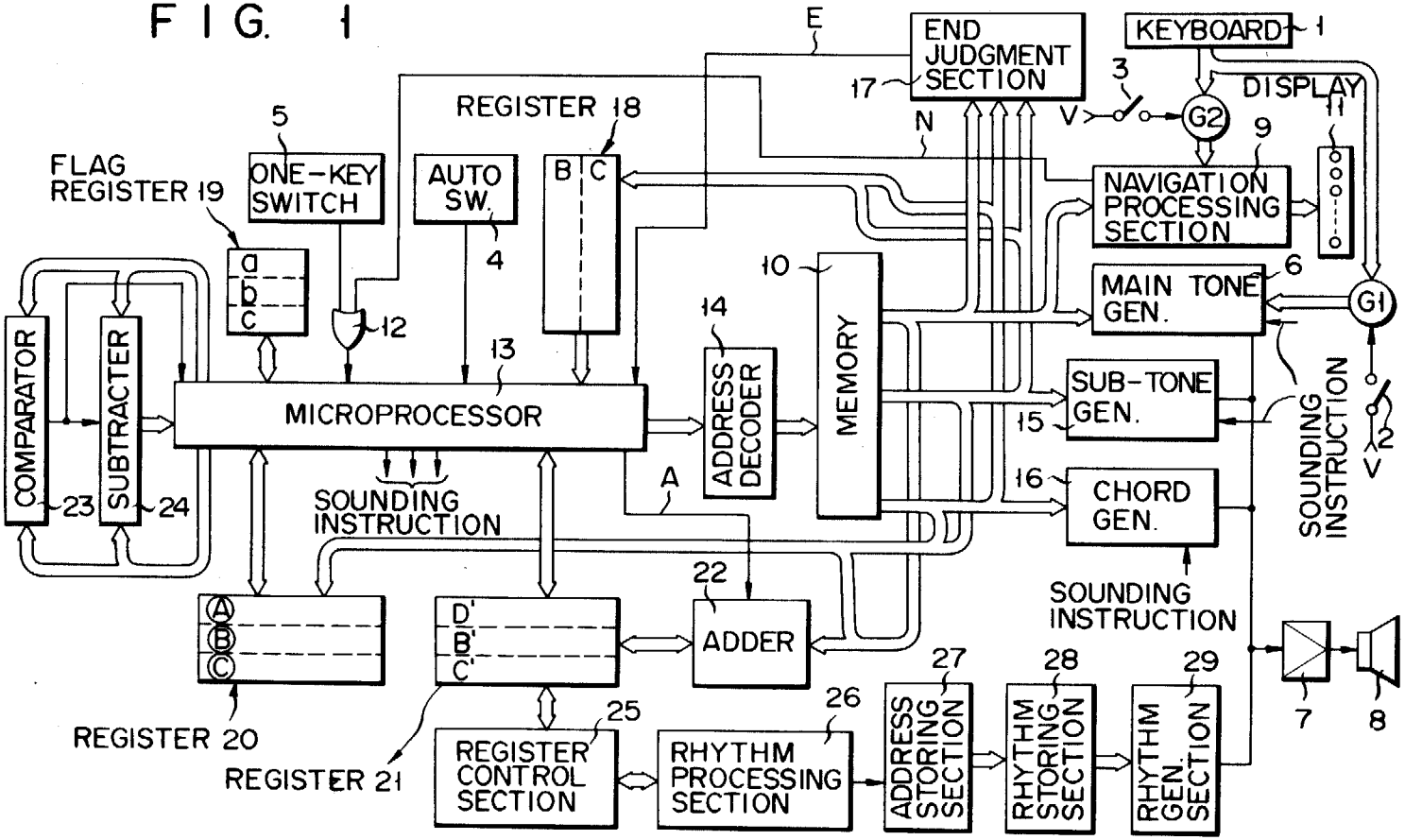
FIG. 1 is a block diagram showing construction of the electric circuit of an embodiment of the electronic musical instrument according to the invention.

FIG. 1 shows the block circuit construction of the embodiment. Referring to the figure, there is shown a keyboard 1 which has a plurality of keys. The output signal from each key on the keyboard 1 is fed to gates Gl and G2. A normal play switch 2, a navigation mode switch 3, a −AUTO (minus auto) switch 4, a one-key switch 5 and other various switches (not shown) including timbre designation switches, rhythm designation switches, a tempo switch and a volume switch are provided in a control section near the keyboard 1.

The normal play switch 2 provides an output at "1" level when it is on, and at "0" level when it is off. This output signal is fed to the gate Gl to control the same. When the gate Gl is enabled (i.e., in a normal play mode), the output of each key on the keyboard 1 is fed to a main tone generator 6. Thus, musical tones are generated according to the key operated and are sounded through an amplifier 7 and loudspeaker 8.

The navigation switch 3, when it is on, provides a "1" output to set the navigation mode in the melody guide function and to enable the gate G2. When the navigation mode is set, the output of each key is fed through the gate G2 to the navigation processor 9. The autoplay data for the melody stored in a memory 10 is fed to the navigation processor 9, and according to this data, the note of the tone to be sounded next is displayed on a display 11. When the right key is operated after the display, a signal N at "1" level is fed to an OR gate 12. The display 11 includes light-emitting diodes (LED) which are provided for each key on the keyboard 1. An "on" LED represents the key of the note to be sounded next. Playing music using the melody guide function is done by operating the keys after they have been displayed. The −AUTO switch 4 is turned on before automatic playing in a one-key play mode or a melody guide mode. Its output is fed to and processed in a control section or a microprocessor 13. The microprocessor 13 controls all the operations of the electronic musical instrument.

The one-key switch 5 is operated for the autoplay function in the one-key play mode. Its output is fed through the OR gate 12 to the microprocessor 13. The microprocessor 13 increments an address decoder 14 according to the output of the OR gate 12, i.e., the signal N, and the output of the one-key switch 5, whereby autoplay data for the melody, obligato and chords are read out from the memory 10 while the other processings for the autoplay are done.

The autoplay data is stored in the memory 10 in a manner as shown in FIG. 8. FIG. 8 shows melody, obligato and chord data of the piece of music shown in FIG. 7. The memory 10 is addressed by 3-bit address data A0 to A2 (hexadecimal code). The address data A0 represents a column address, and address data Al and A0 provide row address. As is seen from FIG. 8, there are stored in the memory 10 from the first area thereof a melody line start address (in this example address data (A0, A1, A2="810"), an obligato start address (A0, A1, A2="050"), a chord line start address (A0, A1, A2="890"), note and "on" data, duration data, note and "off" data of the first tone $B_4{}^b$ of the melody, the corresponding data of the second to sixth tones of the melody, melody line end data, and then similar data for the obligato and chord. In FIG. 8, D.D.C. represents the abbreviation for double duration command.

The autoplay data of the melody read out from the memory 10 is fed to the main tone generator 6 and navigation processor 9. The autoplay data for obligato is fed to a subtone generator 15. The autoplay data for chords is fed to a chord generator 16. The melody can also be referred to as a main tone, and obligato can be referred to as a subtone. When a sounding command is given to the main tone generator 6, subtone generator 15 and chord generator 16' from the microprocessor 13, these generators generate tones corresponding to the respective autoplay data, which is fed through the amplifier 7 and loudspeaker 8 to be sounded.

The end data for the melody, obligato and chord of the memory 10 are fed to an end judgment section 17. When it judges the input of end data, the end judgment section 17 provides a signal E at "1" level, which is fed to the microprocessor 13 to cause the processing which ends the autoplay.

B and C registers in a register section 18 are provided for the subtones and chords. In autoplay processing, duration data for subtones and chords is set in the B and C registers, respectively. A flag register 19 has respective flag areas a, b and c, in which the respective flags are set in the autoplay processing. The register section 20 has Ⓐ, Ⓑ and Ⓒ registers for main tones, subtones and chords, respectively. A register section 21 has D', B' and C' registers for rhythm, subtones and chords, respectively. Main tone duration data read out from the memory 10 during autoplay in the one-key play function and in the melody guide function is fed to the Ⓐ register. Of the data in the B and B' registers, the smaller amount is set in the Ⓑ register. Likewise, for the data in the C and C' registers, the smaller amount is set in the Ⓒ register. The remaining periods of the durations are set in the B', C' and D' registers.

The main tone duration data from the memory 10 and data from the D', B' and C' registers are fed to the adder 22. In the one-key play mode, the adder 22 adds the main tone duration data to the data in the D', B' and C' registers, and sets the result data in the D', B' and C' registers. Data (Δt) equal to data corresponding to the duration of a sixteenth note, is set in an internal register in the adder 22. When the one-key switch 5 is operated for the first time, data (Δt) is added to the main tone duration data set in the D', B' and C' registers, and the resultant data is set in the D', B' and C' registers again. The microcomputer 13 provides a command for adding the data (Δt) as a signal A to the adder 22.

The data in the B and B' registers and data in the C and C' registers are fed through the microprocessor 13 to a comparator 23. The comparator 23 compares the data in the B and B' registers and is in the C and C' registers, and feeds the resulting signal to the microprocessor 13 and a subtracter 24. The data of the B, B', C and C' registers is fed through the microprocessor 13 to the subtracter 24. The subtracter 24 takes the difference between the B and B' register data and also the difference between the C and C' register data according to the resulting signal of the comparator 23, and sets the larger amount of resulting data in register.

A register control circuit 25, a rhythm processing section 26, an address storing section 27, a rhythm storing section 28 and a rhythm generating section 29 are provided to automatically play rhythm. The register control section 25 permits writing and reading of data of the residual rhythm out of and into the D' register to be performed between the rhythm processing section 26 and the D' register. In this case, residual time data, e.g., data corresponding to the duration of one measure, which is stored in the rhythm storing section 28, is first preset in the D' register. Subsequently, the sixteenth note duration data is subtracted from the time data after the lapse of each sixteenth note, which is the shortest unit of rhythm, in the rhythm processing section 26, the resulting data being set again in the D' register. The rhythm processing section 26 compares the subtraction operation with respect to the residual time and also checks whether or not the residual data coincides with the sixteenth note duration data and whether or not count data of a rhythm counter (to be described later) coincides with the sixteenth note duration data. It provides an increment signal to the address storing section 27 according to the results of these operations.

In the rhythm storing section 28 is stored a plurality of different kinds of rhythm data for one measure. One of these different rhythms is designated by operating a corresponding rhythm designation switch. The rhythm data read out in units of sixteenth notes, is fed to the rhythm generating section 29 to generate a rhythm signal, which is sounded through the amplifier 7 and loudspeaker 8.

Figure 2:
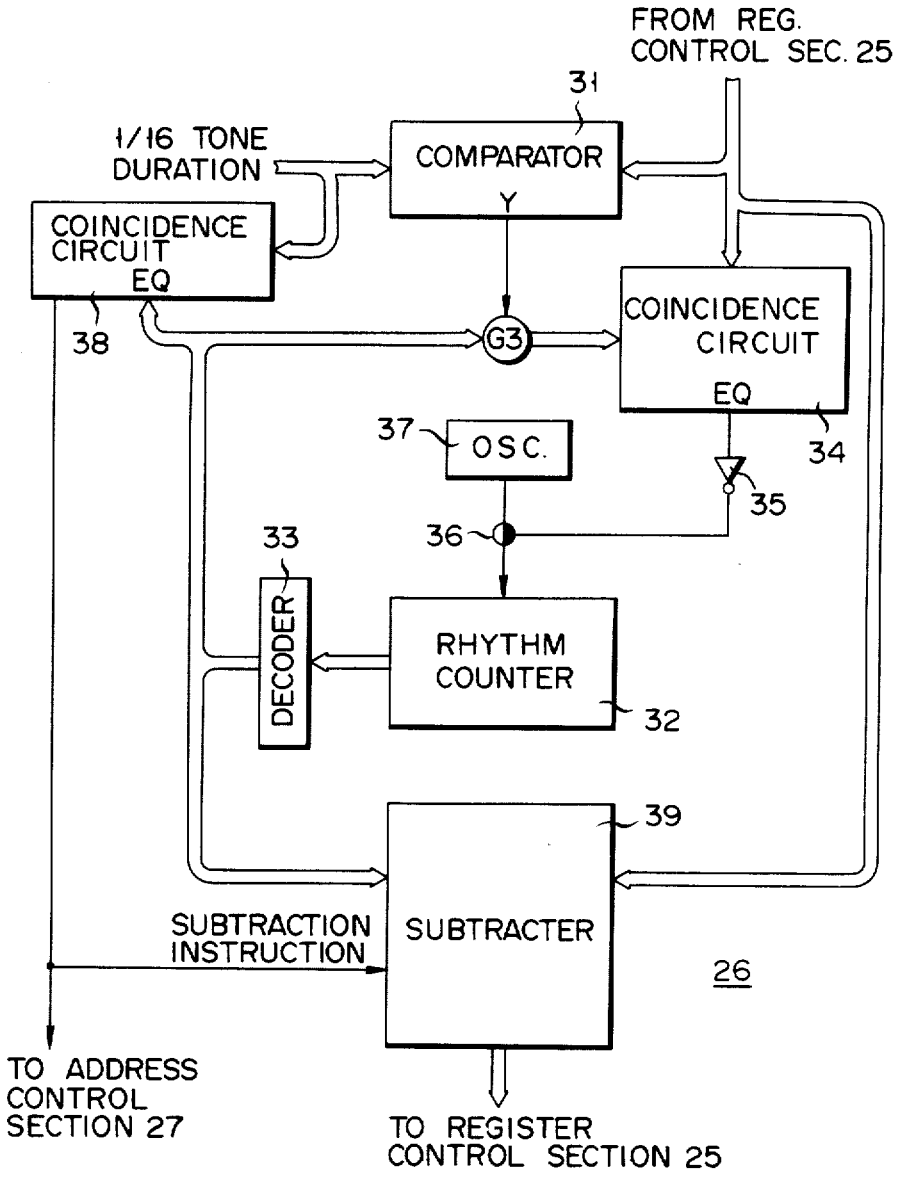
FIG. 2 is a block diagram showing the specific construction of the rhythm processing section shown in FIG. 1.

The specific construction of the rhythm processing section 26 will now be described with reference to FIG. 2. A comparator 31 receives residual time data from the D' register through the register control section 25 and also the sixteenth note duration data. It checks as to whether or not the residual time is less than a sixteenth note. When the residual time is less than a sixteenth note, it provides a signal Y of "1" level to enable a gate G3. When the gate G3 is enabled, the count of a rhythm counter 32 is decoded by a decoder 33, the decoded data being fed to one terminal of a coincidence circuit 34. The residual data from the D' register (in the instant case corresponding to the sixteenth note) is fed to the other terminal of the coincidence circuit 34. When the count reaches the sixteenth note, the coincidence circuit 34 produces a coincidence signal EG of "1" level, which is fed through an inverter 35 to the gate terminal of a transfer gate 36 to enable the same. The transfer gate 36 passes an output signal at a predetermined frequency provided from an oscillator 37 to the rhythm counter 32. Subsequent to the appearance of the "1" level coincidence signal, the input of the predetermined frequency signal to the rhythm counter 32 is thus inhibited, whereby the rhythm autoplay for one measure is stopped.

A coincidence circuit 38 receives the sixteenth note duration data and the count of the rhythm counter 32 coupled through the decoder 33. It compares both input data while the comparator 31 is providing a "0" level signal Y. When the two items of input data coincide, it provides a "1" level coincidence signal EQ, which is fed as an increment signal to the address storing section 27 and which is also fed as a subtraction command to the subtracter 39. The subtracter 39 receives the residual time data from the D' register and the count data of the rhythm counter 32 during up-counting thereof, i.e., the duration of the sixteenth note. It subtracts the sixteenth note duration data from the residual time data, and feeds the result as new residual time data to the D' register to continue the rhythm autoplay.

Now, the operation of the embodiment will be described with reference to FIGS. 3 through 6, and 11. The operation will be described in connection with a case when the melody shown in FIG. 7 is played in the one-key play mode while the obligato, chord and rhythm are automatically played. In this case, the one-key play mode has the timing shown in (A) in FIG. 9.

To start the autoplay in the one-key play mode, the −AUTO switch 4 is turned on. The on signal from the −AUTO switch 4 is fed to the microprocessor 13. This on signal is detected in step S1 in the flow chart of FIG. 3. As a result, data "1" is set in the flag area a in the flag register 19 (step S2). Then, the address decoder 14, address storing section 27, registers in the register sections 18, 20 and 21, and rhythm counter 32 in the rhythm processing section 26 are initialized (step S3). Then, data "0" is set in the flag area b in the flag register 19.

Subsequently, an auto-play process step S5 is executed. This step is illustrated in the flow chart of FIGS. 5A and 5B. The operation concerning obligato will be described mainly for the sake of simplicity. In step N1 shown in FIGS. 5A and 5B, a check is done as to whether or not the data in the Ⓑ register is "0". Since it is "0", the routine goes to step N2, in which a check is done as to whether or not the data in the B' register is "0". Since it is also "0", the routine goes to the rhythm process step S15. This step is illustrated in the flow chart of FIG. 6.

Figure 6:
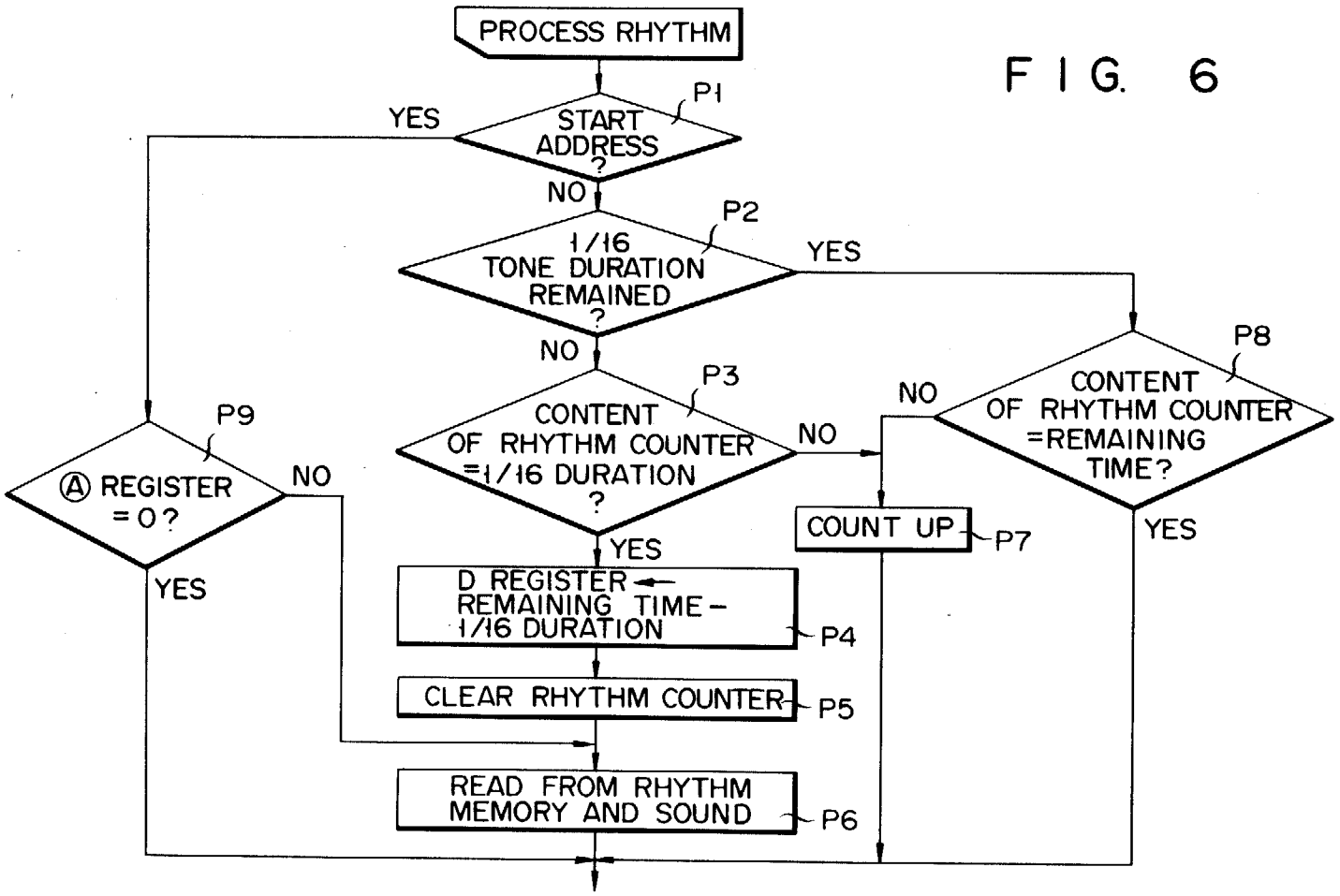
Figure 7:
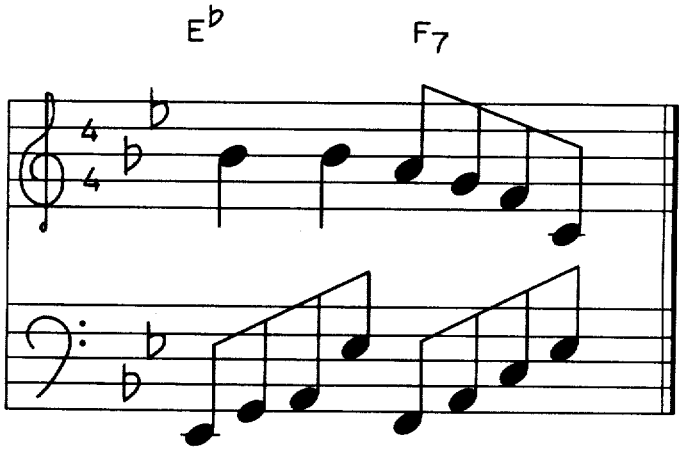
FIG. 7 shows part of a piece of autoplay music.

Referring to FIG. 6, in step P1 a check is done in the address storing section 27 as to whether or not the current address data represents the first address. Since the first address prevails, the routine goes to step P9, in which a check is done as to whether or not the data in the Ⓐ register is "0". Since it is "0", step P9 yields the decision "Yes". In the Ⓐ register data is set when the one-key switch 5 is turned on (as will be described later). Thus, when the one-key play is started, the routine goes from step P9 to step P6, in which the first rhythm data is read out from the rhythm storing section 28 and is fed to the rhythm-generating section 29.

When the rhythm process step N15 is over, the routine goes to tone generation process step S6. In the instant situation, no melody, etc. is produced, and the routine goes through another operation step S7 returning to step SI.

When the play of the first tone (note B) of the melody is started by turning on the one-key switch 5, the on signal thereof is fed through the OR gate 12 to the microprocessor 13, so that the operation of this key is detected through steps S1 and S8. As a result, a one-key process step S9 is started. This step is illustrated in detail in the flow chart of FIG. 4.

Figure 4:
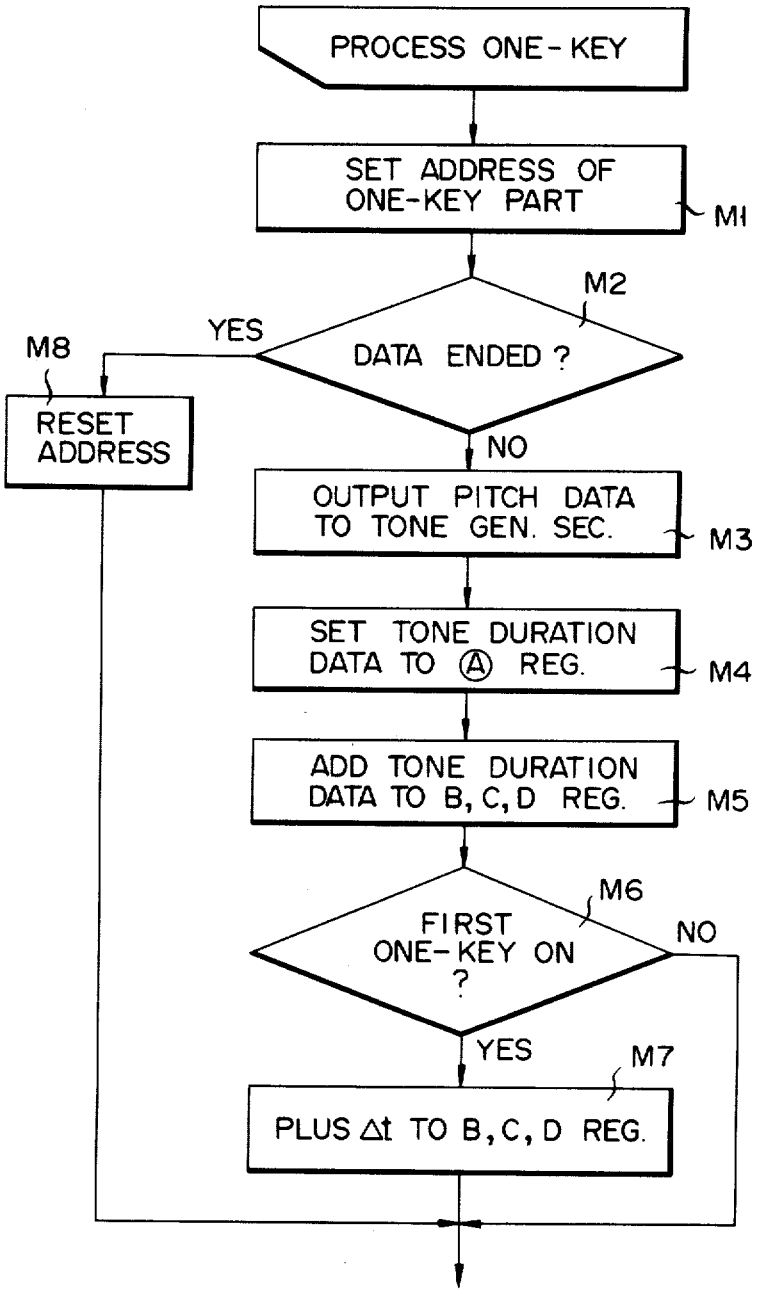
Figure 5A:
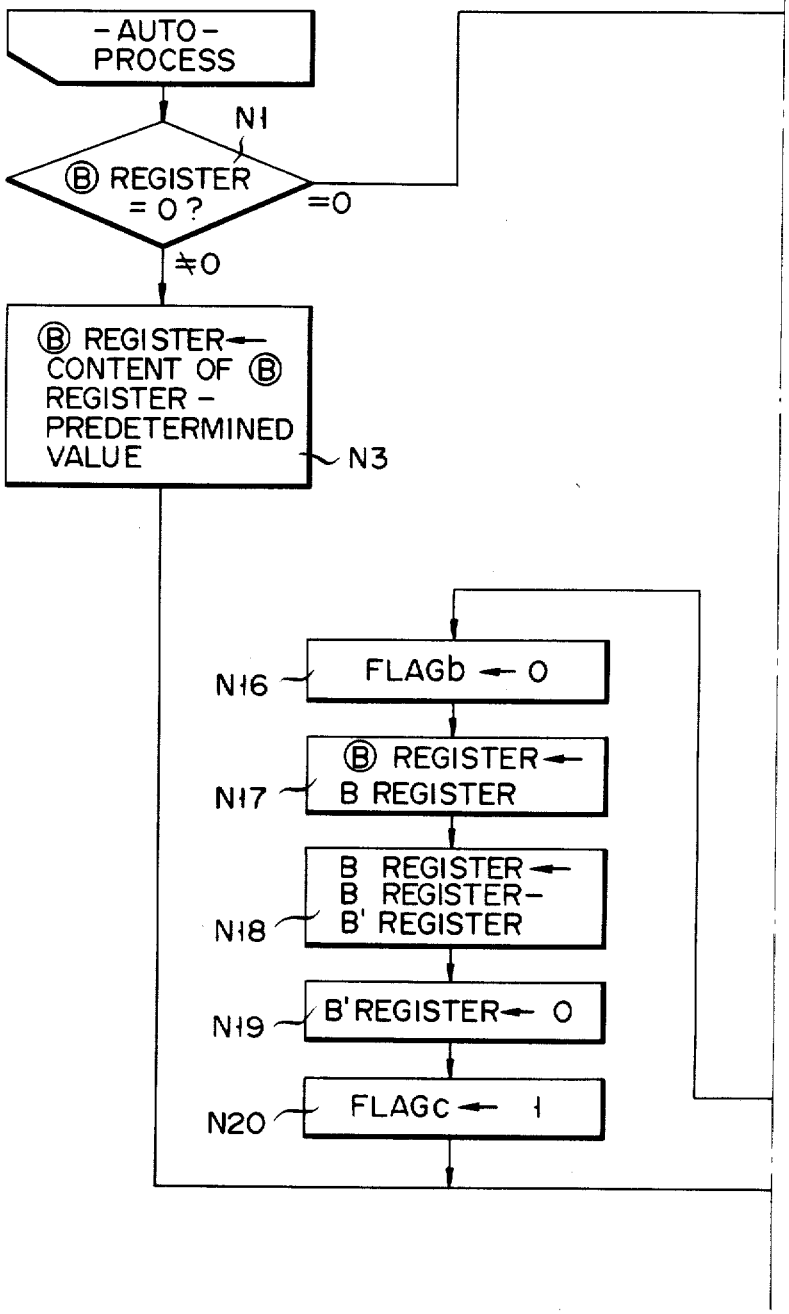
Figure 5B:
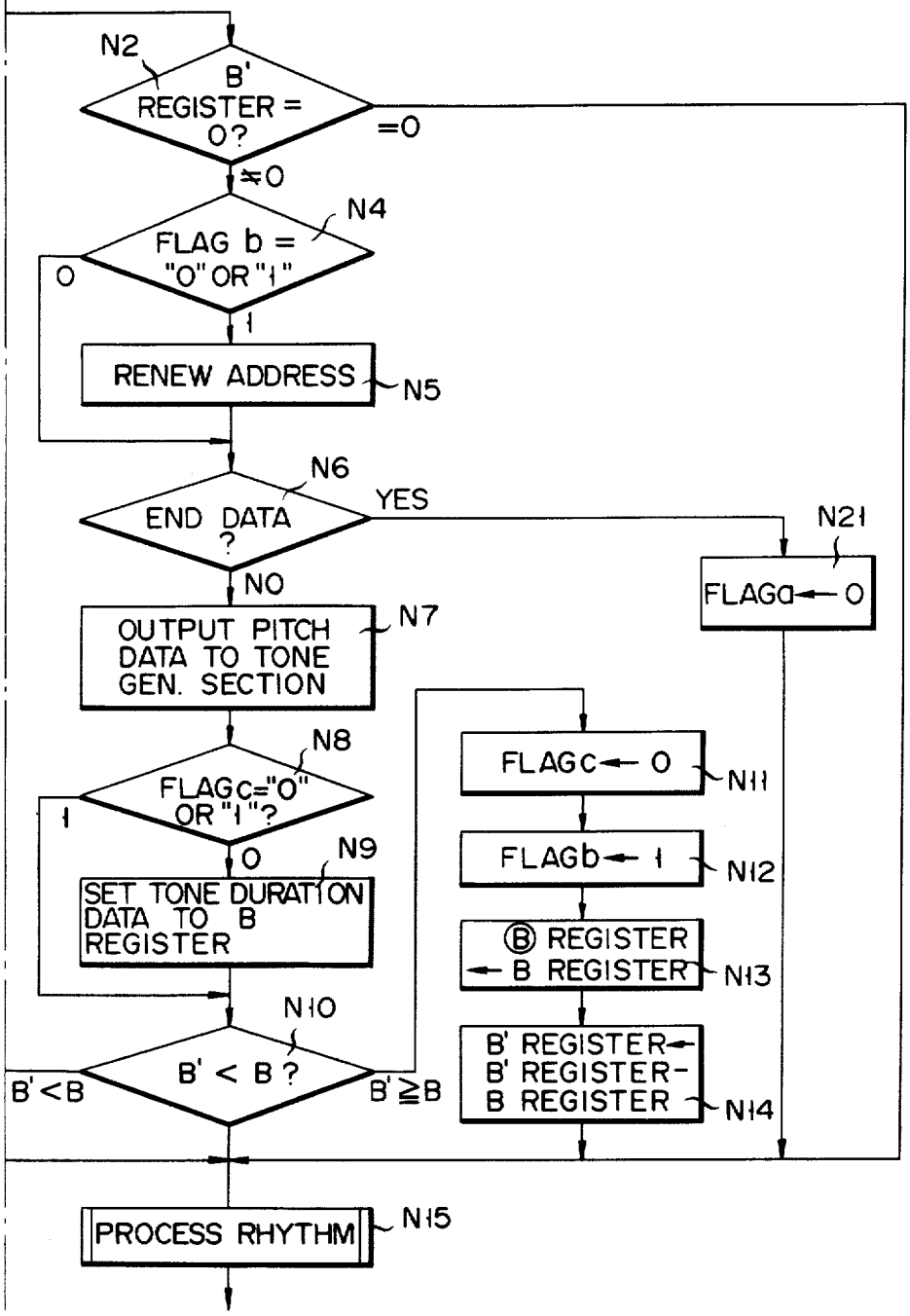

Referring to FIG. 4, the address of one-key part, i.e., the address of the melody, is first set in the address decoder 14 in a step M1. The address data thus set is fed to the memory 10. The data of the first tone (note B) is thus read out to be fed to the main tone generator 6, end judgment section 17, Ⓐ register in the register section 20 and adder 22. In a subsequent step M2, a check is done as to whether the data of the end judgment section 17 is end data. Since it is not end data, a "0" level signal E is fed to the microcomputer 13, so that the routine goes to step M3. In step M3, the note data of the first tone is fed along with a command data (which is "1" when on and "0" when off) provided from the microprocessor 13 to the tone-generating section (i.e., the main tone generator 6) to be sounded through the amplifier 7 and loudspeaker 8.

In a subsequent step M4, the data for the duration of the first tone of the melody, i.e., the duration of the quarter note, is read out to be set in the Ⓐ register. In a subsequent step M3, the tone duration data (corresponding to the quarter note duration) is added to the B', C' and D' registers in the register section 21 by the adder 22. Since the data in the B', C' and D' registers is all "0", the data set in each of the registers as a result of the addition process corresponds to the quarter note duration.

In a subsequent step M6, the microprocessor 13 makes a check as to if the "on" operation of the one-key switch 5 is the first on operation. Since it is the first, the routine goes to step M7, in which the data Δt (corresponding to the duration of the sixteenth note) is added to the data in the B', C' and D' registers by the adder 22. At this time, the microprocessor 13 provides a "1" signal A as addition command to the adder 22. The data in each of the B', C' and D' registers now represents the duration corresponding to that of the quarter note plus (Δt). The data (Δt) is provided in order that if the one-key switch 5 is turned on after a delay time within Δt, i.e., the sixteenth note duration, from the normal on timing, the automatic playing of obligato (i.e., subtone), chord and rhythm is executed at a normal timing without any correction for the delay.

When the one-key process step S9 is over, the autoplay process step S5 is executed. In this step, it is found in the step N2 that the data in the B' register is no longer "0", and the routine goes to step N4. In the instant situation, it is found in step N4 that data in the flag area b is "0", and so the routine goes to step N6. In step N6, a check is done as to whether the first obligato tone (of note E ) is end data. Since it is not end data, the routine goes to step N7, and the first tone note data E is fed along with the music generation command to the subtone generator 15, whereby the obligato is heard.

In a subsequent step N8, a check is done as to if the data in the flag area c is "0" or "1". Since it is "0", the routine goes to step N9, in which the first tone duration data (corresponding to an eighth note duration) is set in the B register. In a subsequent step N10, the data in the B' and B registers are compared by the comparator 23. Since the B' register data represents a duration corresponding to a quarter duration plus Δt while the B register data represents an eighth note duration, the decision that is yielded is B' B, so that the routine goes to a step Nll, in which data "0" is set in the flag area c. In a subsequent step N13, the B register data which now corresponds to the eighth note duration is set in the Ⓑ register. In a subsequent step N14, the result data obtained by subtraction of the B register data corresponding to the eighth note duration from the B' register data corresponding to the quarter note duration plus Δt, i.e., data corresponding to the eighth note duration plus Δt, is set as residual time data in the B' register. Subsequently the rhythm process step N15 is executed, followed by the tone generation step S6, in which the subtone and chord are generated by the generators 6 and 15 and memory 10, and other operation step S1, and the routine then goes back to the step S1.

In the above way, the main tone, subtone and rhythm for the first tone of music simultaneously start to be generated with the first "on" operation of the one-key switch 5. The chord of the first tone (of note $E^b$) also simultaneously starts to be generated. The routine for this is the same as that shown in the flow chart of FIG. 5, so it is not described any further except that the (C), C' C are substituted for the Ⓑ B' and B registers in the flow chart of FIGS. 5A and 5B which concerns the obligato (i.e., subtone).

Until the second "on" operation of the one-key switch 5, the following operation takes place for generating the obligato, chord and rhythm. In the step S8 executed subsequent to the step S1, a decision "No" is yielded for there is no "on" operation of the one-key switch 5, so that the rout to a step S10, in which a check is done as to whether there is a navigation mode (i.e., melody guide mode). Since the decision is "No", the routine goes to the autoplay process step S5.

In this step, it is found in the step N1 that the data in the Ⓑ register is not "0", so that the routine goes to a step N3. In the step N3, a predetermined value is subtracted from the current value in the Ⓑ register (which now corresponds to an eighth note duration) by the subtracter 24, and the result data is set again in the Ⓑ register. This means that the sounding of obligato has been effected to an extent corresponding to the predetermined value noted above. The routine subsequently goes through the steps N15, S6 and S7 before returning to the step S1. The processing for the chord is entirely the same as described above. For the obligato, the steps S1, S8, S10, S5 (N1, N3), N15, S6 and S7 are repeated, and when the data in the Ⓑ register becomes "0", that is, when the eighth note duration of the first tone of obligato has passed and this fact is determined in the step N1, the routine goes to The step N2 and then the step N4. Since the data set in the flag area b now is "1", the microprocessor 13 executes an address renewal in the address decoder 14 in a step N5. Thus, the second tone of obligato (of note G2 and eighth note duration) is read out from the memory 10. Then, in a step N7 which is executed subsequent to the step N6, the note data G2 is fed to the subtone generator 15. In a subsequent step N8, a check is done as to whether the data in the flag area c is "0". Since it is "0", the routine goes to a step N9, in which the eighth note duration data of the second tone of obligato is set in the B register. In a subsequent step N10, a decision B' $(=\frac{1}{8}+\Delta t) \geqq B(=\frac{1}{8})$ is yielded, so that the routine subsequently goes through the steps N11 through N14. Thus, data "0" is set in the flag area c, data "1" in the flag area b, eighth duration data in the Ⓑ register, and data (Δt) in the B' register. In this way, the second tone of obligato is generated and sounded.

For the chord, since the first chord tone is of the half note duration, the operation of tone generation and sounding is continually executed until the one-key switch 5 is turned on for the second time. For the rhythm, in the rhythm process after the start of the tone generation and sounding of the first tone of rhythm, it is found in the step P1 that the current address is not the first address, so that the routine goes to a step P2. In the step P2, a check is done in the comparator 31 as to whether the residual time of the D' register data (which currently corresponds to the quarter note duration plus (Δt) has become less than the sixteenth note duration. Since the decision is "No", the comparator 31 provides a signal Y of "0" so that the gate G3 is disabled. The coincidence circuit 34 thus provides a signal EQ of "0" fed through the inverter 35 to the transfer gate 36 so that the transfer gate 36 is enabled. The output of the oscillator 37 is thus fed to the rhythm counter 32.

In a subsequent step P3, a check is done by the coincidence circuit 38 as to whether the sixteenth note duration has been reached by the period represented by the count of the rhythm counter 32. That is, it is checked whether the sixteenth note duration which is the least unit time of rhythm has passed. The current moment is immediately after the start of the sounding of the first tone of rhythm, so that the signal EG of the coincidence circuit 38 is "0", i.e., represents noncoincidence. Thus, the rhythm counter 32 continues counting (step P7). The steps P1 through P3 and P7 are executed repeatedly in every rhythm process step N15 until the first tone duration (i.e., sixteenth note duration) of rhythm has passed.

When the first tone sixteenth note duration of rhythm has passed, this is detected in the step P3, and the coincidence signal EQ of the coincidence circuit 38 goes to "1", thus providing a subtraction command to the subtracter 39 and incrementing the address storing section 27. Thus, the sixteenth note duration data is subtracted form the data corresponding to the quarter note duration plus Δt in the subtracter 39, and the result is set in the D′ register again (step P4). Then the rhythm counter 32 is reset to start counting afresh for the next second tone (step P5). The second tone data of rhythm is thus read out from the rhythm processing section 28 and fed to the rhythm generating section 29. The tone generation and sounding of the second tone is thus started.

Now, an operation of generating rhythm for one measure when the one-key switch 5 is depressed again will be described. When the sixteenth note duration for each tone of rhythm has passed, the steps P1 to P3 and P7 and also the steps P1 through P6 are executed. When the first rhythm tone of the next measure has been sounded, the comparator 31 detects in the step P2 that the sixteenth note duration is reached by the time represented by the D′ register data. Thus, it provides a signal Y of "1" to enable the gate G3, thus permitting the count data of the rhythm counter 32 (i.e., the decoded data of the decoder 33) to be fed to the coincidence circuit 34. The coincidence circuit 34 compares this count data from the rhythm counter 32 with the sixteenth note duration data fed from the D′ register to the other input terminal (step P6). The count is progressively increased from "0" (step P7). When the sixteenth note duration of the last tone of rhythm has passed, the coincidence circuit 34 generates a signal EQ of "1" to disable the transfer gate 36. Thus, the counting of the rhythm counter 32 is stopped, that is, the rhythm is ended immediately before the start of tone generation and sounding of the second tone of the next measure.

When the duration of the second tone of obligato (i.e., eighth note duration) has passed through repeated execution of the step N3, the data in the Ⓑ register becomes "0". This is detected in the step N1, so that the steps N2 and N4 through N9 are executed, whereby the third tone data of obligato is read out and fed to the subtone generator 15 to be sounded. Also, the duration of the third tone (i.e., data corresponding to the eighth note duration) is set in the B register. The step N10 thus yields a decision $B'(=\Delta t)<B(=\frac{1}{8})$, so that the routine goes to a step N16, in which data "0" is set in the flag area b. Then the B′ register data (Δt) is set in the (B) register (step N17). Further, data $(\frac{1}{8}-\Delta t)$ obtained as a result of subtraction of the B′ register data (Δt) from the B register data $(\frac{1}{8})$ in the subtracter 24, is set in the B register (step N18). Then the B′ register is reset (step N19), and data "1" is set in the flag area c (step N20).

Figure 9:
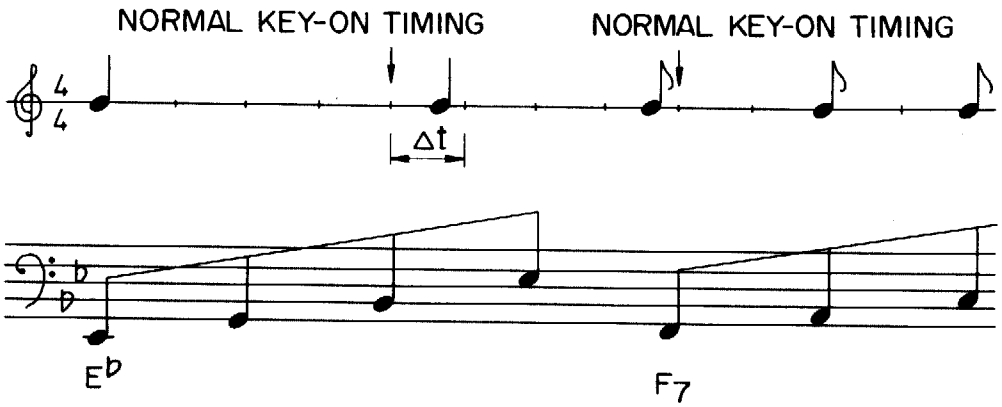
FIGS. 9 and 10 show the relation between the progress of music and the depression of the keys.

It is now assumed that the one-key switch 5 is turned on after a delay time less than the sixteenth note duration from the normal timing as shown in FIG. (A) in FIG. 9, while the third tone of obligato is being generated and sounded and the step N3 is being repeatedly executed. In this case, the steps M1 through M6 are executed in the one-key process step S9 executed after the steps S1 and S8. Thus, the main tone generator 6 starts generation of the second tone of melody (of note $B_4{}^b$ and quarter note duration), the quarter note duration data is set in the A register, and the B′, C′ and D′ registers are set to this data.

It will be understood that even if the generation and sounding of the second tone of melody are started after a delay time within Δt, the third tone of obligato, chord and rhythm are all sounded normally, i.e., without any delay.

When the third tone of obligato is sounded for the time interval Δt according to the data (Δt) in the Ⓑ register so that the Ⓑ register data becomes "0", in the autoplay process step it is decided in the step N10 executed after the steps N2, N4 and N6 through N9 that $B'(=\frac{1}{4})\geqq B(\frac{1}{8}-\Delta t)$. The routine thus goes through the steps N11 through N14. Thus, data "0" is set in the flag area c, data "1" is set in the flag area b, data $(\frac{1}{8}+\Delta t)$ is set in the B register, and data $(\frac{1}{4})-(\frac{1}{8}-\Delta t)$, i.e., $(\frac{1}{8}+\Delta t)$, is is set in the B′ register. When the Ⓑ register data becomes "0" through the repeated execution of the steps N1 and N3, the routine goes through the steps N2 and N4 through N9, whereby the fourth tone of obligato is generated and sounded at the normal timing. i.e., without any delay. Thus, the eighth note duration data is set as the fourth tone data of obligato in the B register. The step N1 thus yields a decision $B'(\frac{1}{8}+\Delta t)\geqq B(\frac{1}{8})$, so that the routine goes through the steps N11 through N14. Thus, data "0" is set in the flag area c, data "1" in the flag area b, data $(\frac{1}{8})$ in the Ⓑ register, and data $[(\frac{1}{8}+\Delta t)-(\frac{1}{8})]$, i.e., (Δt), in the B′ register. When the one-key switch 5 is turned on for the third tone of melody (main tone) earlier than the normal timing, as shown in (A) in FIG. 9, i.e., before the data (Δt) set in the Ⓑ register becomes "0" through repeated execution of the step N3, the steps M1 through M6 in the one-key process are executed. Thus, the third tone of melody (of note $A_4$ and eighth note duration) is read out from the memory 10 and fed to the main tone generator 6. Also, the duration data (corresponding to the eighth note duration) is set in the Ⓐ register and is added to the data in the B′, C′ and C′ registers. The B′ register data thus becomes $(\Delta t+\frac{1}{8})=(\frac{1}{8}+\Delta t)$. When the Ⓑ register becomes "0" again, the fourth tone of obligato is read out and sounded through the steps N1 and N2 through N9. At this time, the eighth note duration data is set in the B register. The step N10 thus yields a decision $B'\geqq B$, so that the steps N11 through N14 are executed to set data "0" in the flag area c, data "1" in the flag area b, eighth duration data in the Ⓑ register and data (Δt) in the B′ register. It will be understood that even if the "on" operation of the one-key switch 5 for the third tone of melody is executed earlier than the normal timing, the autoplay of obligato, chord and rhythm is executed without any correction but at the normal timing. The subsequent autoplay is similarly executed. When the end data of main tone is read out in the one-key process of FIG. 4, the step M2 yields a decision "Yes", so that the routine goes to a step M3 to reset the address decoder 14.

Figure 10:
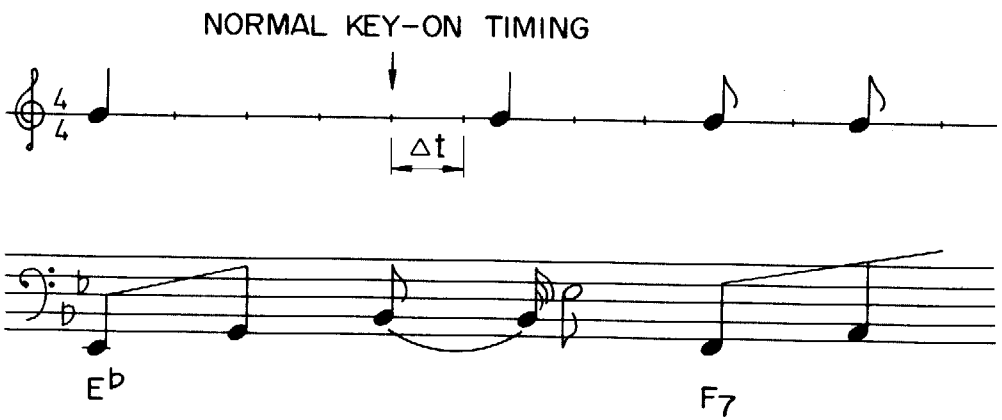

Now, the operation that takes place when the one-key switch 5 is turned on for the second tone of melody after a delay time in excess of Δt form the normal timing, will be described with reference to FIG. 10.

In this case, the same operation takes place as has been described before in connection with FIG. 9 insofar as the melody, obligato, chord and rhythm are started for the first tone with the first "on" operation of the one-key switch 5 and the third tone is started so long as obligato is taken into considerations. At the instant when the third tone of obligato has been sounded for the duration Δt, data "0" and "1" are in the respective flag areas b and c, and data (Δt), ($\frac{1}{8}$ − Δt) and "0" are in the respective Ⓑ, B and B' registers.

With the completion of sounding of the third tone for the time interval Δt in this state, the Ⓑ register data is reduced to "0" in the step N3. Now it is found in the step N2 that the B' register data is "0", thus causing the routine to go to the step N15. At this instant, the progress of obligato has been stopped. When the one-key switch 5 is turned on for the second tone of melody after the lapse of the interval Δt and then a thirty-second note duration interval, the steps M1 through M6 are executed to start the second tone of melody. Also, the quarter duration data of the second tone is set in the Ⓐ register and added to the data in the B', C' and D' registers. The B' register data now thus corresponds to the quarter note duration. Then, when the autoplay process step sets in, the step N10 subsequent to the steps N1, N2, N4 and N6 through N8 yields a decision B' ($=\frac{1}{4}$)≧B($\frac{1}{8}$ − Δt), so that the steps N11 through N13 are executed. Thus, data "0" and "1" are set in the respective flag areas c and b, respectively, and the data in the Ⓑ and B' registers are ($\frac{1}{8}$ − Δt) and ($\frac{1}{8}$ + Δt), respectively.

With the duration data ($\frac{1}{8}$31 Δt) thus set in the Ⓑ register, the third tone of obligato continues to be sounded until this duration data in the Ⓑ register is brought to "0" in the step N3. When the Ⓑ register data becomes "0", the steps N1, N2 and N4 through N9 are executed to start sounding of the fourth tone of obligato and set the eighth note duration of the fourth tone in the B register. In the subsequent step N10, a decision B'($=\frac{1}{8}$ + Δt)B($=\frac{1}{8}$) is yielded, and then the steps N11 through N14 are executed to set data "0" and "1" in the respective flag areas c and b, and duration data ($\frac{1}{8}$) and (Δt) are set in the respective Ⓑ and B' registers.

It is to be understood that if the one-key switch 5 is turned on for the second tone of melody after a time interval longer than Δt, in the above example the time interval (Δt + 1/32), from the normal timing, the duration of sounding of the third tone of obligato is corrected, and the sounding duration is prolonged for the thirty-second note duration. When the prolonged sounding of the third tone is completed, the fourth tone of obligato is sounded together with chord and rhythm. The subsequent autoplay proceeds with the delay time corresponding to the thirty-second note duration from the normal timing maintained over the rest of music.

Figure 3:
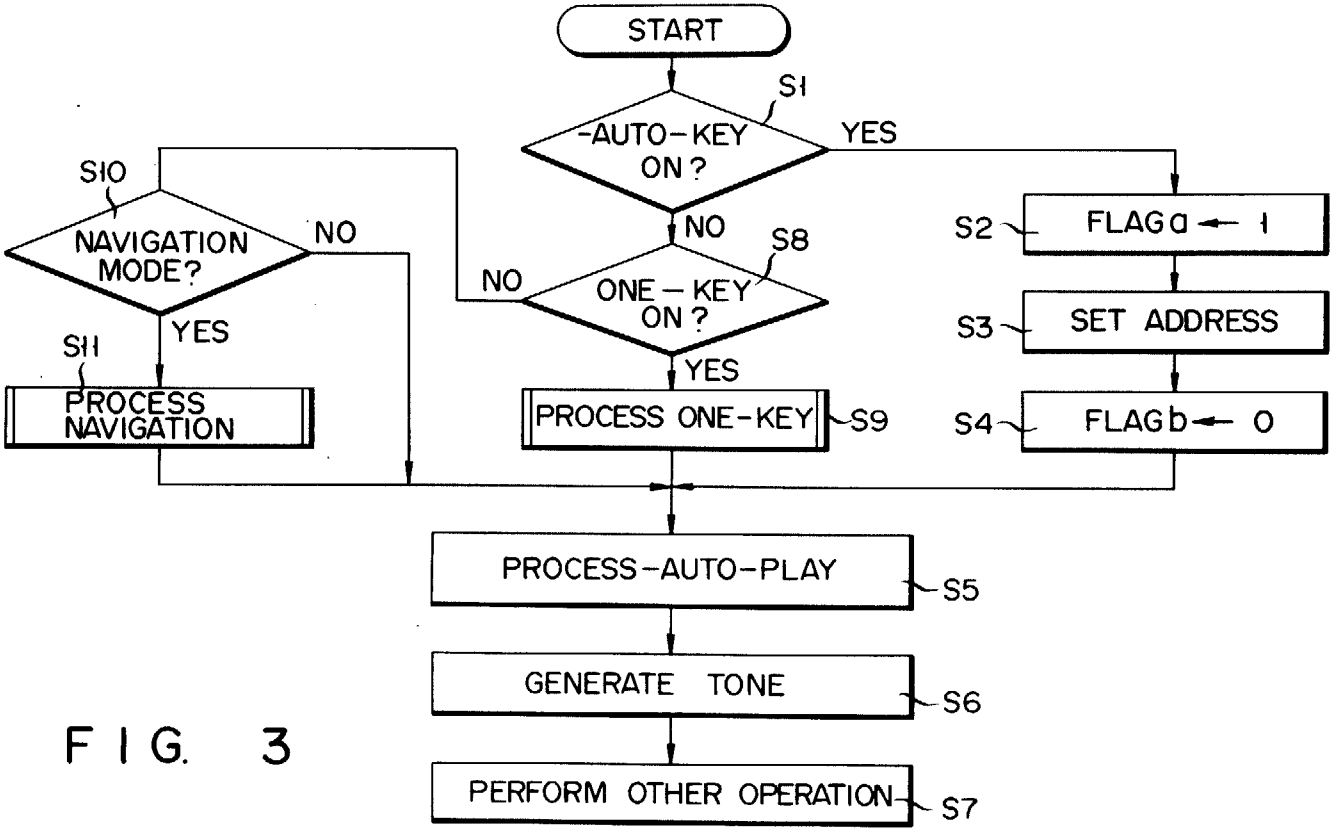
FIGS. 3 to 6 and 11 are flow charts explaining the operation of the circuit shown in FIGS. 1 and 2.
Figure 11:
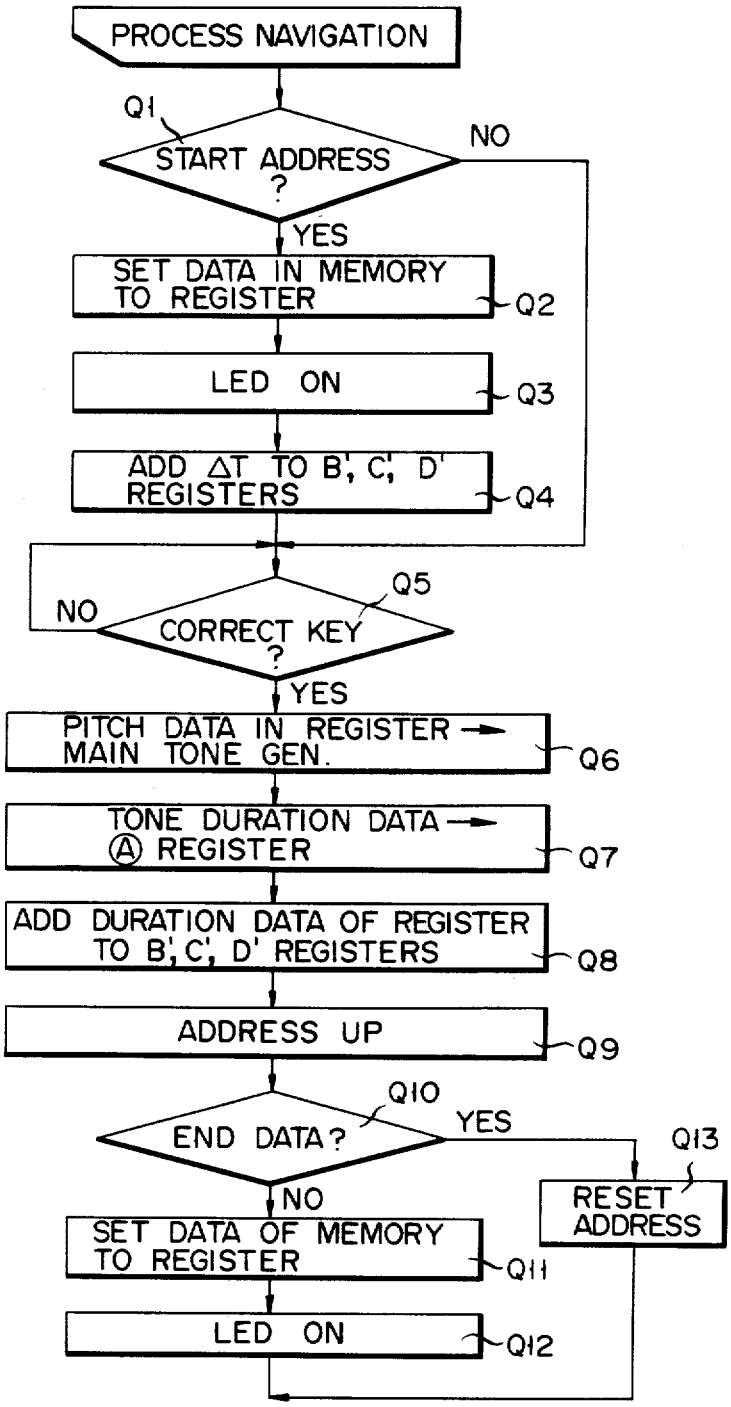

Now, the operation of autoplaying the music shown in FIG. 7 in the melody guide mode will be described with reference to the flow chart of FIG. 11. When the −AUTO switch 4 is turned on at the start of the play and then the navigation mode switch 3 is turned on, the steps S1 through S7, S1 and S8 shown in FIG. 3 are executed, and then the step S10 is executed, in which it is found that the navigation mode is set. The routine thus goes to the navigation process step S11. With the "on" operation of the navigation mode switch 3 the gate G2 is enabled to be ready to permit the output of each key on the keyboard 1 to be fed to the navigation processor 9.

In the navigation process step, a check is done first in a step Q1 as to whether the first address prevails. Since the first address prevails, the routine goes to a step Q2, in which the first tone data of melody (of note B and quarter note duration) read out from the memory 10 in a predetermined register of the navigation processor 9. The note data in the register is then fed to the display 11 to turn on the LED for the note $B_4{}^b$ (step Q3). In a subsequent step Q4, the duration data (Δt) is added to the B', C' and D' registers by the adder 22, that is, the data (Δt) is set in these registers. The player turns on the key for the note $B_4{}^b$ by watching the LED display. If the key operation is correct, it is judged as such in a step Q5, so that the routine goes to a step Q6, in which the note data $B_4{}^b$ in the predetermined register is fed to the main tone generator 6 to start sounding of the first tone. In a subsequent step Q7, the tone duration data corresponding to the quarter duration in the predetermined register, is set in the Ⓐ register. In a subsequent step Q8, the tone duration data in the predetermined register is added to the data in the B', C' and D' registers by the adder 22. Thus, tone duration data ($\frac{1}{4}$ + Δt) is set in the B', C' and D' registers. In a subsequent step Q9, the main tone address in the address decoder 14 is incremented for a signal N of "1" level has been provided from the navigation processor 9 and fed through the OR gate 12 to the microprocessor 13 with the first key operation. The second tone (of note $B_4{}^b$ and quarter duration) is then read out. In a subsequent step Q10, a check is done as to whether the read-out data is end data. Since it is not end data, the routine goes to a step Qll, in which the data of the second tone is set in the predetermined register in the navigation processor 9. According to this data, the LED corresponding to the note of the second tone is turned on to display the key to be depressed next (step Q12).

When the navigation process corresponding to the one-key process has been executed in the above way, subsequent autoplay processing for obligato, chord and rhythm including the autoplay process step S5 is the same as has been described earlier in connection with FIGS. 9 and 10. Also, when the end data of melody is read out in the navigation process, this is detected in the step Q10, and the address decoder 14 is reset in a step Q13, thus bringing an end to the autoplay in the navigation mode.

In the above embodiment the timing of play is compared to the normal timing and, if the result is that the former is delayed behind the latter for more than a predetermined range, the autoplay of obligato, chord and rhythm is stopped. However, this is not limitative. For example, the tempo may be gradually slowed down or the autoplay may proceed at a slower tempo than the normal tempo when the play timing is delayed for more than the predetermined range. Further, the above embodiment has arranged such that when the one-key switch is turned on after a delay time in excess of the predetermined range, the normal tempo of the autoplay of obligato, chord and rhythm is subsequently recovered. However, this is not limitative, and the tempo of operation of the one-key switch may be followed, or the autoplay may proceed at a slower tempo than the previous one.

Further, in the above embodiment when the one-key switch is turned on earlier than the normal timing, the tempo of the autoplay of obligato, chord and rhythm is not changed but remains constant. Like the case when the timing of the "on" operation of the one-key switch is delayed behind the normal timing, it may be arranged such that the tempo of autoplay of obligato, etc. remains fixed so long as the advancement of the timing is within a predetermined range, but when the advancement exceeds the predetermined range the autoplay for obligato, etc. is fast fed up to the "on" operation timing and then the initial tempo is recovered.

Further, when the tempo of autoplay is not changed but remains fixed when the timing of play by the performer differs from the normal timing within a predetermined range, the autoplay tempo may be changed to various values when the predetermined range is exceeded.

As has been described in the foregoing, in the electronic musical instrument according to the invention, in which a plurality of autoplay data for simultaneous play are stored and are sequentially read out at a predetermined timing for autoplay, the timing of operation of main playing means for main autoplay data is compared to the normal timing, and if the result of comparison is within a predetermined range the reading secondary autoplay data is executed in compliance with the normal timing, and if the result is beyond the predetermined range, the timing of reading of the secondary autoplay data is corrected. Thus, even if the timing of playing is deviated within the predetermined range, the secondary autoplay data can be played without interruption. This is very convenient for the beginner who can then practice with pleasure.

What is claimed is:

1. An electronic musial instrument having a keyboard and comprising:

memory means for storing a plurality of different autoplay data;

reading means coupled to said memory means for retrieving selected autoplay data sequentially at a predetermined timing frequency;

comparing means for comparing said predetermined timing frequency with a timing of play operation executed by a player on said keyboard for generating a time difference signal; and correcting means coupled to said comparing means for modifying the predetermined timing frequency for retrieving said autoplay data when said time difference signal is beyond a predetermined range while retrieving said autoplay data at the predetermined timing frequency when the time difference signal is within the predetermined range.

2. The electronic musical instrument according to claim 1, wherein said correcting means includes means for suspending retrieval of said autoplay data for a time interval in excess of said predetermined range when said time difference signal is beyond said predetermined range.

3. The electronic musical instrument according to claim 1, wherein said retrieval means includes means for sequentially retrieving and automatically playing said autoplay data for one tone after another every time a predetermined key on said keyboard is operated.

4. An electronic musical instrument comprising:

memory means for storing a plurality of different autoplay data;

reading means coupled to said memory means for retrieving selected autoplay data sequentially at a predetermined timing frequency;

guide means for indicating at least the note of a tone to be sounded next by a player;

a keyboard to be operated by a player in accordance with the indication of said guide means;

comparing means for comparing said predetermined timing frequency with a timing of play operation executed by a player on said keyboard for generating a time diffrence signal; and correcting means coupled to said comparing means for modifying the predetermined timing frequency for retrieving said autoplay data when said time difference signal is outside a predetermined range while retrieving said autoplay dta at the predetermined timing frequency when the time difference signal is within the predetermined range.

5. The electronic musical instrument according to claim 4, wherein said correcting means includes means for suspending the retrieval of said autoplay data for a time intermal in excess of said predetermined range when said time difference signal is beyond said predetermined range.

* * * * *

UNITED STATES PATENT AND TRADEMARK OFFICE

CERTIFICATE OF CORRECTION

PATENT NO. : 4,630,518

DATED : December 23, 1986

INVENTOR(S) : R. USAMI

It is certified that error appears in the above-identified patent and that said Letters Patent is hereby corrected as shown below:

IN THE TITLE PAGE:

Under the heading "References Cited - Foreign Patent Documents", include the following reference:

--3121253 6/1982 Fed. Rep. of Germany--.

Signed and Sealed this

Fourteenth Day of June, 1988

*Attest:*

*Attesting Officer*

DONALD J. QUIGG

*Commissioner of Patents and Trademarks*